US005853307A

United States Patent [19]

Natsume

[11] Patent Number: 5,853,307

[45] Date of Patent: Dec. 29, 1998

[54] TRIM SENSOR FOR OUTBOARD DRIVE

[75] Inventor: Noriyuki Natsume, Hamamatsu, Japan

[73] Assignee: Sanshin Kogyo Kabushiki Kaisha, Japan

[21] Appl. No.: 690,551

[22] Filed: Jul. 31, 1996

[30] Foreign Application Priority Data

Jul. 31, 1995 [JP] Japan ..... 7-195542

[51] Int. Cl.[6] ..... B63H 20/10

[52] U.S. Cl. ..... 440/2

[58] Field of Search ..... 440/2, 1

[56] References Cited

U.S. PATENT DOCUMENTS

| | | | |
|---|---|---|---|
| 3,844,247 | 10/1974 | Collis et al. | 440/2 |
| 4,005,674 | 2/1977 | Davis | 440/2 |
| 4,722,705 | 2/1988 | Rawlings | 440/2 |
| 5,049,099 | 9/1991 | Ito et al. | 440/61 |
| 5,215,484 | 6/1993 | Saito | 440/61 |

FOREIGN PATENT DOCUMENTS

| | | | |
|---|---|---|---|
| 64-79601 | 3/1964 | Japan . | |
| 274688 | 11/1990 | Japan | 440/2 |

*Primary Examiner*—Sherman Basinger
*Attorney, Agent, or Firm*—Knobbe, Martens, Olson & Bear, LLP

[57] ABSTRACT

A simply-structured trim sensor measures the trim position of an outboard motor. The sensor operates between a pivot pin, which is fixed to a clamping bracket, and a swivel bracket, which rotates about the pivot pin. The sensor is arranged between the clamping and swivel brackets in a position which allows ready access to the sensor. A technician therefore can easily adjustment or repair the sensor without disassembling any portion of the clamping and swivel brackets, and without moving the outboard motor.

20 Claims, 5 Drawing Sheets

TRIM SENSOR FOR OUTBOARD DRIVE

BACKGROUND OF THE INVENTION

1. Field of the Invention

The present invention relates to an outboard drive of a watercraft, and in particular to a trim sensor which detects the trim position of the outboard drive on the watercraft.

2. Description of Related Art

The desirable trim angle of an outboard drive varies with a watercraft's running condition. For instance, the bow of the watercraft should press against the water when accelerating from rest or from a slow speed. To achieve this condition, the angle of the propeller shaft is disposed at a negative angle relative to the horizontal (i.e., at a negative trim angle). A thrust vector produced by the propeller in this position is thus out of the water. When running at high speed, the propeller is raised or trimmed to position the propeller shaft at a positive trim angle relative to the horizontal within the range of about 0° to 15°.

A hydraulic tilt and trim system often supports and adjusts the trim position of a large outboard motor (e.g., 150 hp or greater). The tilt and trim system includes hydraulic actuators which operate between a clamping bracket, which is attached to the watercraft, and a swivel bracket which supports the outboard motor. A pivot pin connects the swivel and clamping brackets together. The actuators cause the swivel bracket to pivot about the axis of the pivot pin relative to the stationary clamping bracket.

A trim sensor of the tilt and trim system commonly measures the rotational angle of the swivel bracket. The trim sensor typically is mounted between the clamping bracket and swivel bracket arms to protect the sensor. The trim sensor must be assembled while the swivel bracket is fully tilted up. Thus, when the swivel bracket returns to a lowered, operational condition, the swivel and clamping brackets cover the trim sensor.

This conventional location and mounting arrangement of the trim sensor poses several drawbacks. Technicians often find it difficult to adjust the trim sensor to indicate a zero degree angle (i.e., zero-out the trim sensor) with the sensor tucked between the clamping bracket and the swivel bracket. This of course must be done with the outboard motor tilted down and positioned in its lowest operating condition. The position also makes it inconvenient to replace the trim sensor because the swivel bracket has to be completely tilted up to gain access to the mounting screws on the trim sensor.

SUMMARY OF THE INVENTION

A need therefore exists for a simply-structured trim sensor which is easily accessible within the tilt and trim device without moving the outboard motor and the tilt and trim system.

An aspect of the present invention thus involves a tilt and trim apparatus for moving an outboard drive of a watercraft between a raised position and a lowered position. The tilt and trim apparatus includes a first member attached to the watercraft and a second member attached to the outboard drive. The first and second members are interconnected with the second member being rotatable relative to the first member. The outboard drive also rotates with the second member. A sensor operates between the first and second members to determine the angular position of the second member and the outboard drive relative to the watercraft. The sensor is arranged between the first and second members so as to be exposed when viewed from a position within the watercraft with the outboard drive in the lowered position.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF THE PREFERRED EMBODIMENT

Figure 1:
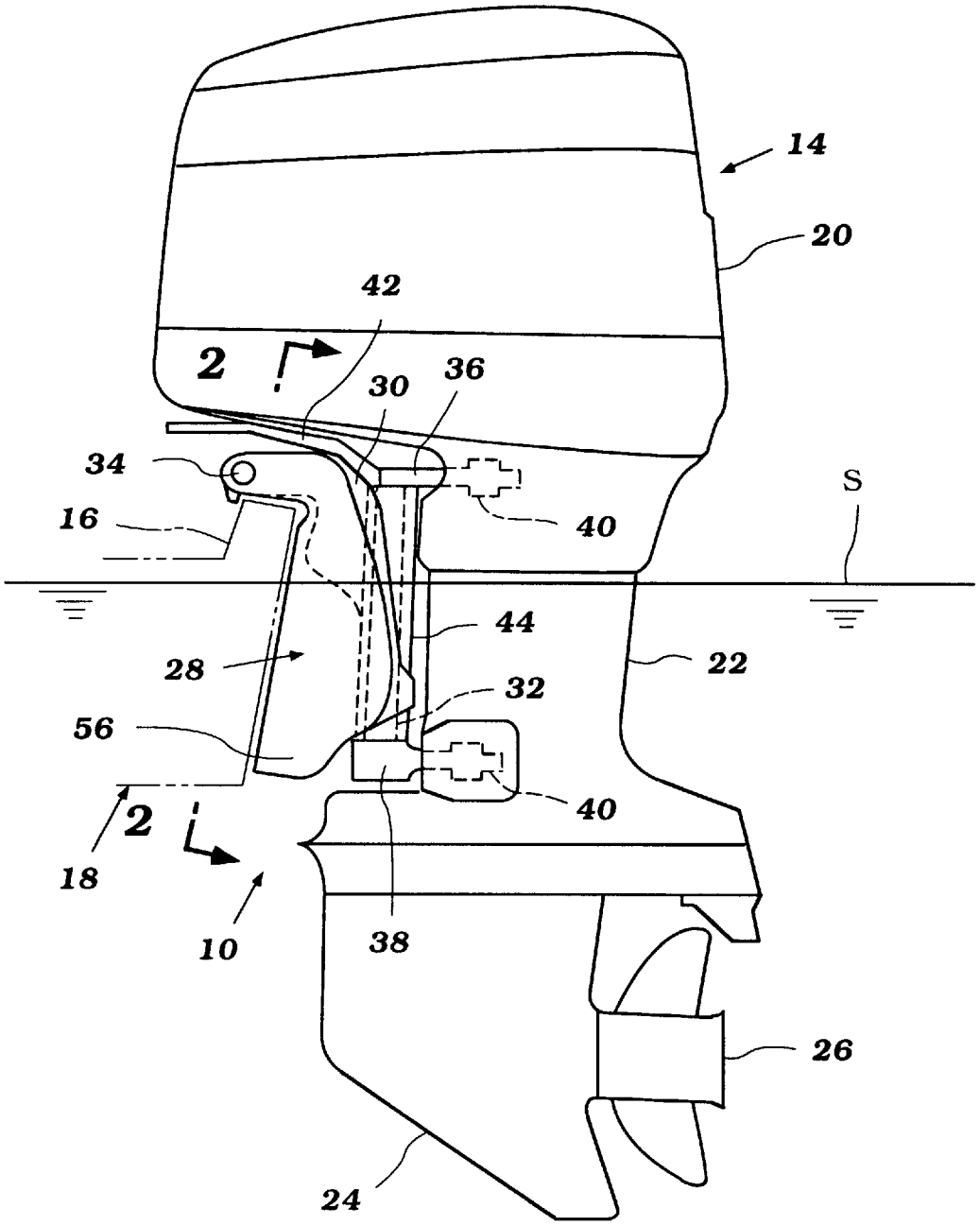
FIG. 1 is a side elevational view of a tilt and trim device configured in accordance with a preferred embodiment of the present invention supporting an outboard motor on a transom of a watercraft.
Figure 2:
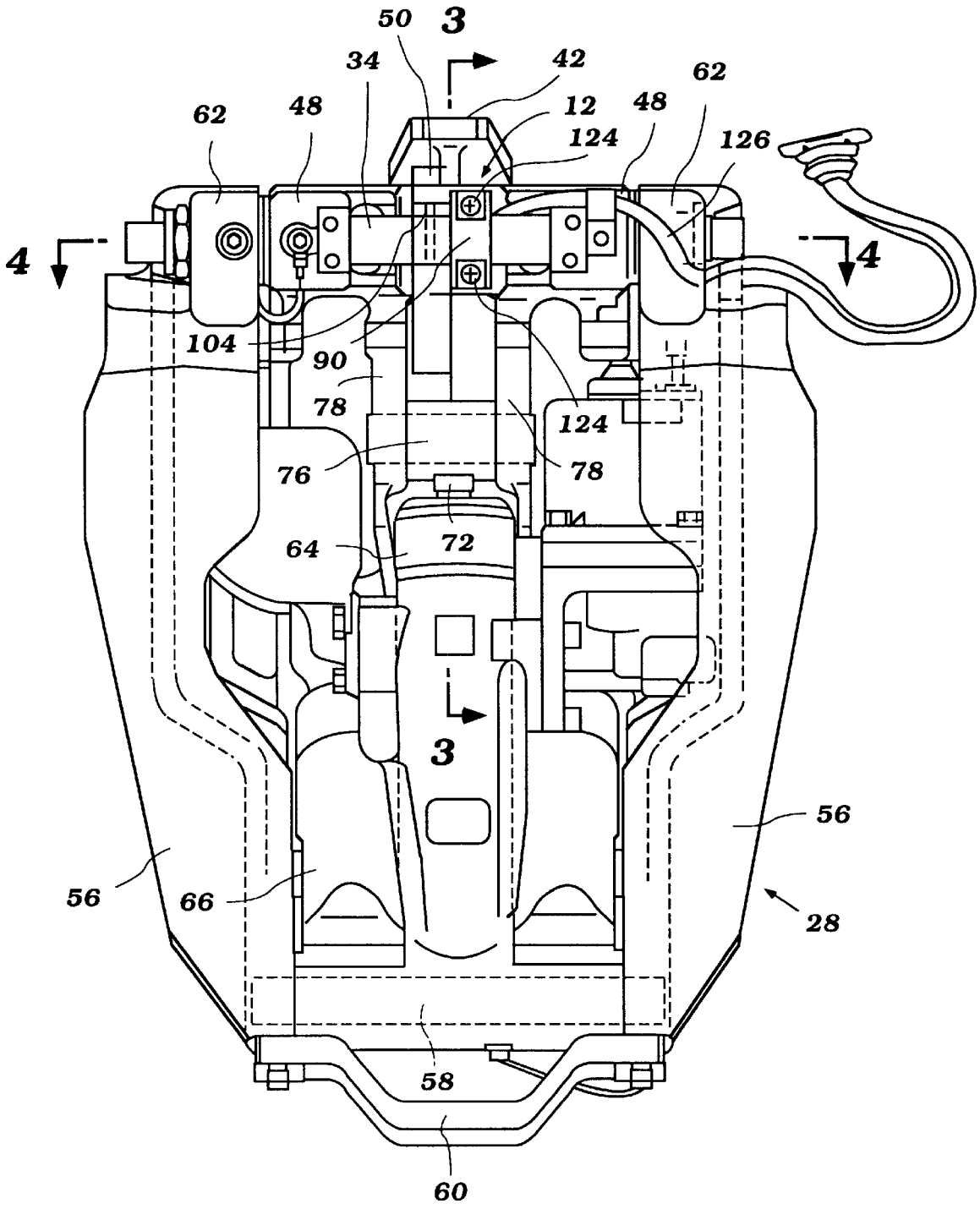
FIG. 2 is front elevational view of the tilt and trim device of FIG. 1 taken in the direction of line 2—2.

FIG. 1 illustrates a tilt and trim system 10 which incorporates a trim sensor 12 (FIG. 2). The trim sensor 12, as described below, is configured in accordance with a preferred embodiment of the present invention, and is arranged at an accessible position within the tilt and trim system 10.

In the illustrated embodiment, the tilt and trim system 12 supports an outboard motor 14 on a transom 16 of a watercraft 18. Although the trim sensor 12 is shown with an outboard motor 14, the trim sensor 12 has applicability with a variety of other type of outboard drives, such as, for example, an outboard motor, or a stem drive of an inboard/outboard motor. Thus, as used herein, the term "outboard drive" generically means an outboard-mounted propulsion unit.

Although the actual construction of the outboard motor 14 forms no part of the invention, the following initially will describe the outboard motor 14 in order to provide the reader with an understanding of the illustrated environment of use.

The outboard motor 14 has a power head 20 which desirably includes an internal combustion engine. The internal combustion engine can have any number of cylinders and cylinder arrangements, and can operate on a variety of known combustion principles (e.g., on a two-stroke or a four-stroke principle).

A protective cowling assembly surrounds the engine. The cowling assembly includes a lower tray and a top cowling. The tray and the cowling together define a compartment which houses the engine with the lower tray encircling a lower portion of the engine.

The engine is mounted conventionally with its output shaft (i.e., a crankshaft) rotating about a generally vertical axis. The crankshaft drives a drive shaft, as known in the art. The drive shaft depends from the power head 20 of the outboard motor 14.

A drive shaft housing 22 extends downwardly from the lower tray and terminates in a lower unit 24. The drive shaft extends through the drive shaft housing 22 and is suitably journaled therein for rotation about the vertical axis.

The drive shaft continues into the lower unit 24 to drive a propulsion shaft through a transmission. The propulsion shaft drives a propulsion device 26 which the lower unit 24 supports.

In the illustrated embodiment, the propulsion device 26 comprises a propeller. The propulsion device, however, can take the form of a dual, counter-rotating propeller system, a hydrodynamic jet, or like propulsion device.

A coupling assembly of the tilt and trim system 10 supports the outboard motor 14 on the watercraft transom 16 so as to position the propulsion device 26 in a submerged position with the watercraft 18 resting on the surface S of a body of water. The coupling assembly is principally formed between a clamp bracket 28, a swivel bracket 30, a steering shaft 32, and a pivot pin 34. FIGS. 1–5 illustrate these components of the coupling assembly.

The steering shaft 32 is affixed to the drive shaft housing 22 through upper and lower brackets 36, 38. An elastic isolator 40 connects each bracket 36, 38 to the drive shaft housing 22. The elastic isolators 40 permit some relative movement between the drive shaft housing 22 and the steering shaft 32 and contain damping mechanisms for damping engine vibrations transmitted from the drive shaft housing 22 to the steering shaft 32.

The steering shaft 32 is rotatably journaled for steering movement about a steering axis within the swivel bracket 30. A tiller 42 is attached to an upper end of the steering shaft 32 to steer the outboard motor 14, in a known manner. Rotation of the tiller 42 rotates the steering shaft 32, as well as the drive shaft housing 22 which is connected through the upper and lower brackets 36, 38, about the steering axis.

Figure 3:
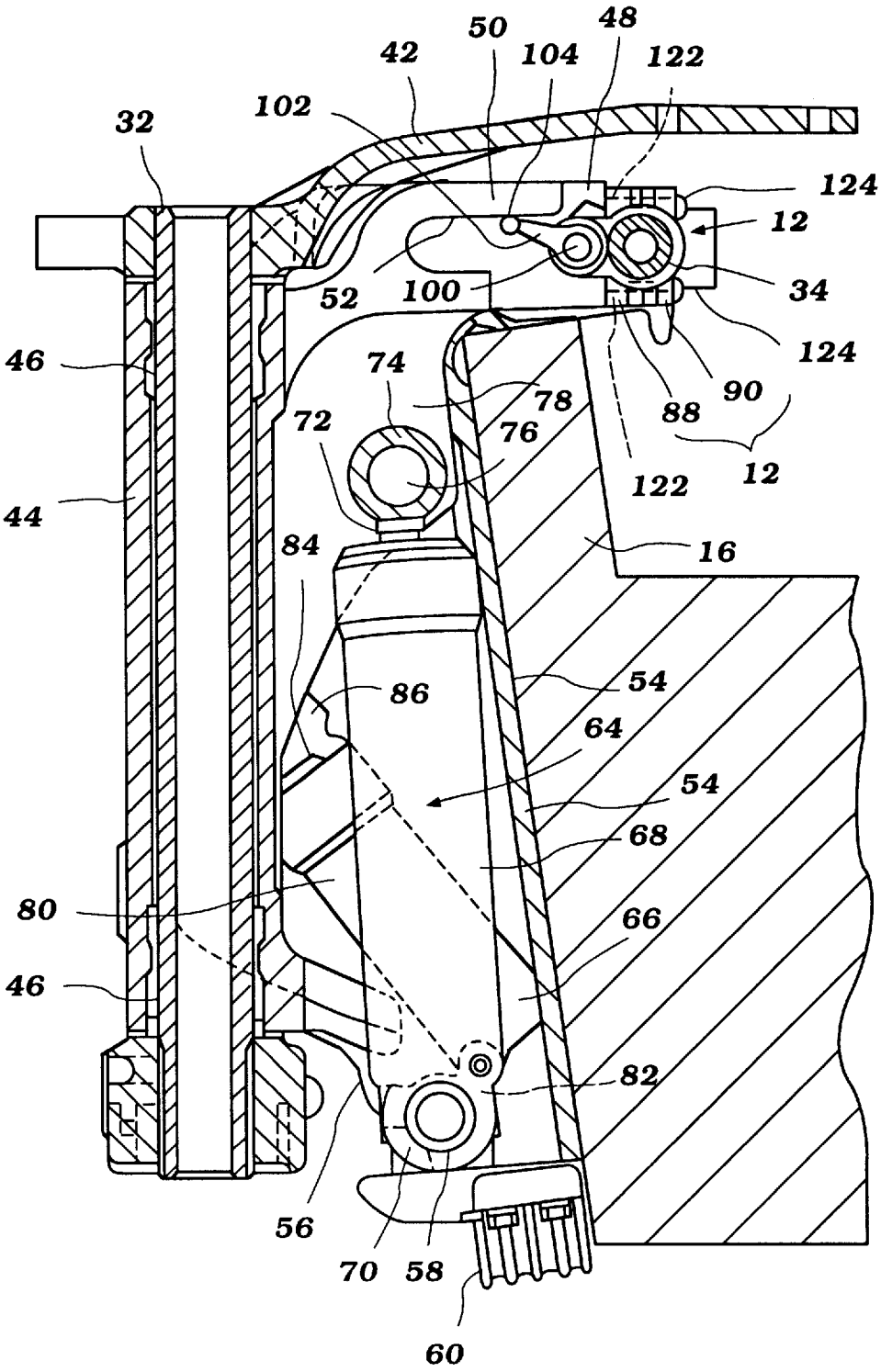
FIG. 3 is cross-sectional side view of the tilt and trim device of FIG. 2 taken along line 3—3 and illustrated in connection with the watercraft transom.

The swivel bracket 30 includes a cylindrical housing 44 through which the steering shaft 32 extends. As best seen in FIG. 3, a plurality of bearing assemblies 46 journal the steering shaft 32 within the cylindrical housing 44. In the illustrated embodiment, upper and lower needle bearing assemblies 46 support the steering shaft 32 within the cylindrical housing 44.

The swivel bracket 30 also includes a pair of lugs 48 which project forwardly toward the watercraft transom 16. Each lug 48 includes a coupling hole at its front end. The coupling holes are aligned with each other along a common pivot axis.

As best seen in FIG. 3, a central rib 50 also projects forwardly at a position between the lugs 48. The rib 50 terminates at a point behind the coupling holes of the lugs 48. The rib 50 defines a lower contact surface 52 which lies within a plane that is generally normal to the steering axis. The contact surface 52 also lies above the pivot axis and generally parallel to the pivot axis.

As best seen in FIGS. 1 through 3, the clamping bracket 28 is affixed in a conventional manner to the transom 16. The clamping bracket 28 includes a support plate 54. The support plate 54 abuts the outer surface of the transom 16 when the clamping bracket 28 is attached to the watercraft 18.

A pair of flanges 56 project toward the outboard motor 14 from the sides of the support plate 54. The flanges 56 are spaced apart from each other by a sufficient distance to receive the swivel bracket 30 between the flanges 56. The flanges 56 also shield the space between the support plate 54 and the cylindrical housing 44 of the swivel bracket 30 to protect the inner components of the tilt and trim system 10.

As best seen in FIGS. 2 and 3, a support shaft 58 extends between the flanges 56 at the lower end of the clamping bracket 28 and within the protected space. Each end of the support shaft 58 is fixed to one of the bracket flanges 56.

A handle 60 also is attached to the bracket flanges 56. The handle 60 is located below the axis of the support shaft 58 at the bottom of the clamping bracket 28.

Upper arms 62 extend from the upper ends of the flanges 56 and into the watercraft 16. The upper arms 62 include coupling holes positioned at the front end of the arms 62. The coupling holes of the arms 62 are aligned with the coupling holes of the swivel bracket lugs 48 along the common pivot axis.

The pivot pin 34 completes the hinge coupling between the clamping bracket 28 and the swivel bracket 30. The pivot pin 34 extends through the aligned coupling holes of the clamping bracket arms 62 and the swivel bracket lugs 48 and is fixed to the clamping bracket arms 62. The inner surfaces of the coupling holes through the swivel bracket lugs 48 act as bearing surfaces as the swivel bracket 30 rotates about the pivot pin 34. The outboard motor 10 thus can be pivoted about the pivot axis defined by the pivot pin 34, through a continuous range of trim positions. In addition, the pivotal connection permits the outboard motor 10 to be tilted up and out of the water for storage or transport, as known in the art.

A hydraulically-operated tilt and trim mechanism operates between the clamping bracket 28 and the swivel bracket 30 to effectuate the tilt and trim movement of the outboard motor 10. In the illustrated embodiment, the tilt and trim mechanism comprises a hydraulic tilt fluid motor 64 and a pair of hydraulic trim fluid motor 66.

As seen in FIG. 3, the tilt fluid motor 64 includes an outer cylinder 68 which defines a cylinder bore. A mounting lug 70 projects from the bottom of the cylinder 68. A hole extends through the lug 70. The hole receives the support shaft 58 which couples the lower end of the tilt cylinder 64 to the lower end of the clamping bracket 28.

A piston slides within the bore with upper and lower fluid chamber being formed on either side of the piston within the cylinder bore. A piston rod 72 is affixed to the piston and extends upwardly through an upper sealed end of the cylinder 68. The piston rod 72 terminates in a trunnion 74.

A pivot pin 76 connects the trunnion 74 of the tilt motor cylinder 68 to the swivel bracket 30. The pivot pin 76 extends between a pair of inner lugs 78. The inner lugs 78 are symmetrically positioned relative to the steering axis and lie between the upper lugs 48 of the swivel bracket 30.

So coupled, the tilt fluid motor cylinder 68 extends between the bottom of the clamping bracket 28 and the inner lug 78 of the swivel bracket 30 at a central position between the upper lugs 48 and upper arms 62 of the swivel and clamping brackets 28, 30, respectively. The stroke axis of the tilt fluid motor piston rod 72 generally lies within the same vertical plane in which the steering axis lies. The stroke axis also extends at an angle which is slightly skewed from the vertical.

Although not illustrated, the tilt fluid 64 motor desirably includes a hydraulic shock-absorbing mechanism for resisting "pop-up" of the outboard motor 14 about the pivot axis during reverse thrust operation. The shock-absorbing mechanism also allows of the outboard motor 14 to raise up when the lower unit 24 of the outboard motor 14 strikes an underwater obstacle, and then to return to the established trim position once the lower unit 24 clears the underwater obstacle.

The pair of hydraulic trim fluid motors 66 lies on either side of tilt fluid motor 64 within the space defined between the clamping bracket flanges 56. The trim fluid motors 66 have a substantially shorter stroke than the tilt fluid motor 64. The trim fluid motors 66 operate in parallel along parallel stroke axes. As best seen in FIG. 3, the stroke axes extend in an direction oblique to the stroke axis of the tilt fluid motor 64.

Each trim fluid motor 66 includes an outer cylinder 80 which defines a cylinder bore. A mounting bracket 82 is attached to bottom of the cylinder 80. A hole extends through the bracket 82. The hole receives the support shaft 58 which couples the lower end of the trim cylinder 80 to the lower end of the clamping bracket 28.

A piston slides within the bore and forms at least one fluid chamber within the cylinder 80. A piston rod 84 is affixed to the piston and extends upwardly through an upper sealed end of the cylinder 80. The piston rod 84 includes a rounded end which engages a bearing plate 86 secured to the swivel bracket 30. The piston rod 84 acts against the bearing plate 86 as the fluid chamber is pressurized or depressurized, as described below.

A hydraulic circuit powers and controls the tilt and trim fluid motors 64, 66. Any of a variety of conventional hydraulic circuits can be used with the tilt and trim fluid motor assembly. Because the hydraulic circuit forms no part of the present invention, a further description is not believed necessary for an understanding of the present invention.

As well know in the art, when the hydraulic circuit pressurizes the cylinder bores below the pistons of the trim fluid motors 66, the pistons move upward and exerts a force through the piston rod 84 on the swivel bracket 30 so as to raise (i.e., trim-up) the outboard motor 14. The swivel bracket 30 rotates about the pivot pin 34 under the force of the trim fluid motors 66. Lowering (i.e., trim-down) of the of outboard motor 14 is accomplished in a similar manner, but in the opposite direction.

Figure 6:
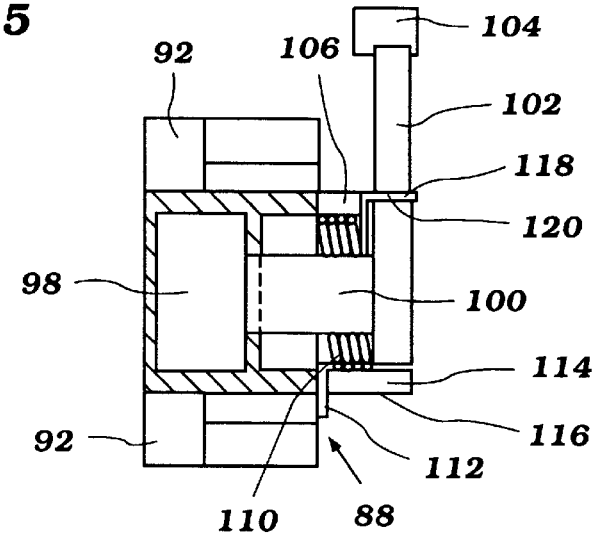
FIG. 6 is a sectional view of the sensor of FIG. 5 taken along line 6—6.
Figure 7:
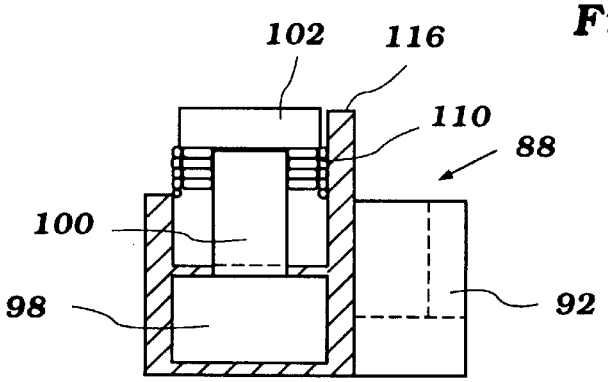
FIG. 7 is a sectional view of the sensor of FIG. 5 taken along line 7—7.

As best seen in FIG. 3, the trim sensor 12 operates between the swivel bracket 30 and the stationary pivot shaft 34, which is affixed to the clamping bracket 28, to determine the rotational angular position (i.e., the trim position) of the outboard motor 14. The trim sensor 12 includes a sensor body 88 and a coupling bracket 90. The sensor body 88 and the coupling bracket 90 are position around the pivot pin 34 with the sensor body 88 located behind the pivot pin 34. It is contemplated, however, that the sensor 12 could be fixed to the swivel bracket instead with a follower portion of the sensor acting against either a stationary datum formed on the pivot pin 34 or the clamping bracket 28. The individual components of the trim sensor 12 will now be describe in detail with reference to FIGS. 5–7.

The sensor body 88 includes a C-shaped bracket portion 92 which cooperates with the coupling bracket 90 to secure the sensor body 88 to the pivot pin 34. The C-shaped bracket 92 has an groove 94 defined between a pair of abutment ends 96. Each abutment end includes at least one threaded hole.

In the illustrated embodiment, the groove 94 has an arcuate shape. The radius of curvature of the groove 94 desirably matches the radius of the pivot pin 34. The origin of the radius, however, lies slightly in front of the abutment ends 96 to promote contact between the surface of the groove 94 and the pivot pin 34 when the trim sensor 12 is attached.

The sensor body 88 houses a rotational sensor 98 (e.g., a conventional potentiometer) behind the C-shaped bracket 92. A rotatable shaft 100 extends from the sensor 98 to the side of the sensor body 88.

A follower causes the sensor shaft 100 to rotate with rotational movement of the swivel bracket 30 about the pivot pin 34. In the illustrated embodiment, a sensor arm 102 is fixed to the end of the end of the shaft 100 and terminates at a contact element 104.

The contact element 104, which is positioned at the outer end of the sensor arm 102, desirably has a cylindrical shape with a smooth exterior surface. Although the contact element 104 is illustrated as being fixed to the sensor arm 102, the contact element 104 alternative can be rotationally supported at the end of the sensor arm 102.

Figure 5:
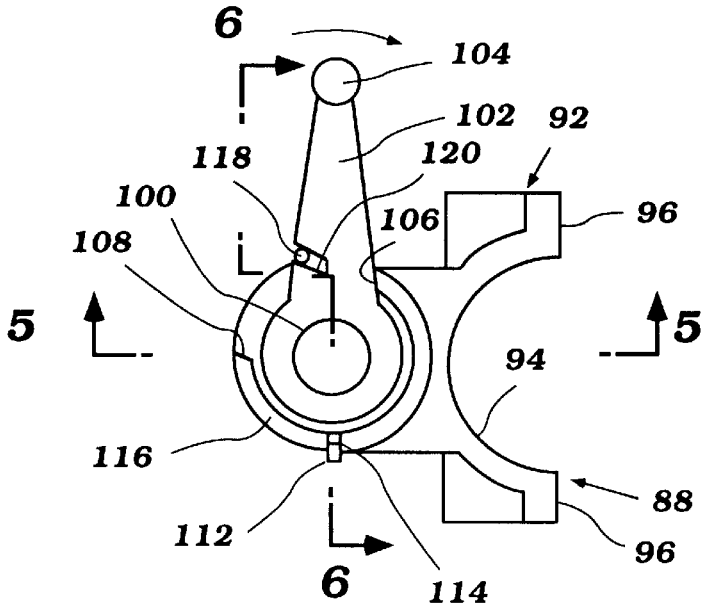
FIG. 5 is a side elevational view of a trim sensor of the tilt and trim device of FIG. 3.

The sensor arm 102 and the sensor shaft 100 rotate together through an arc defined by upper and lower stops 106, 108. The stops 106, 108 are formed on the sensor body 98 and limit the rotational travel range of the sensor arm 102. In the illustrated embodiments, the stops 106, 108 are positioned apart from each other to allow the sensor arm 102 to rotate through about a 90° arc. As seen in FIG. 5, the sensor arm 102 extends in a direction generally parallel to the abutment ends 96 of the C-shaped bracket 92 of the sensor body 88 when contacting the upper stop 106. When the sensor arm 102 contacts the lower stop 108, the arm 102 extends generally normal to the abutment ends 96.

A biasing mechanism 110 desirably biases the sensor arm 102 against the upper stop 106 (in the clockwise direction as illustrated in FIG. 5). In the illustrated embodiment, the biasing mechanism 110 is a helical torsion spring that operates between the sensor body 88 and the sensor arm 102. A first end 112 of the spring 110 fits within a groove 114 formed through a wall 116 of the sensor body 88. The spring first end 112 lies transverse to the axis of the sensor shaft 100. A second end 118 of the spring 110 fits within a groove 120 formed within the sensor arm 102. The spring second end 118 extends generally parallel to the axis of the sensor shaft 100. And as best seen in FIG. 5, first and second spring ends 112, 118 generally lie on diametrically opposite sides of the sensor shaft 110 with the sensor arm 102 abutting the upper stop 106.

Figure 4:
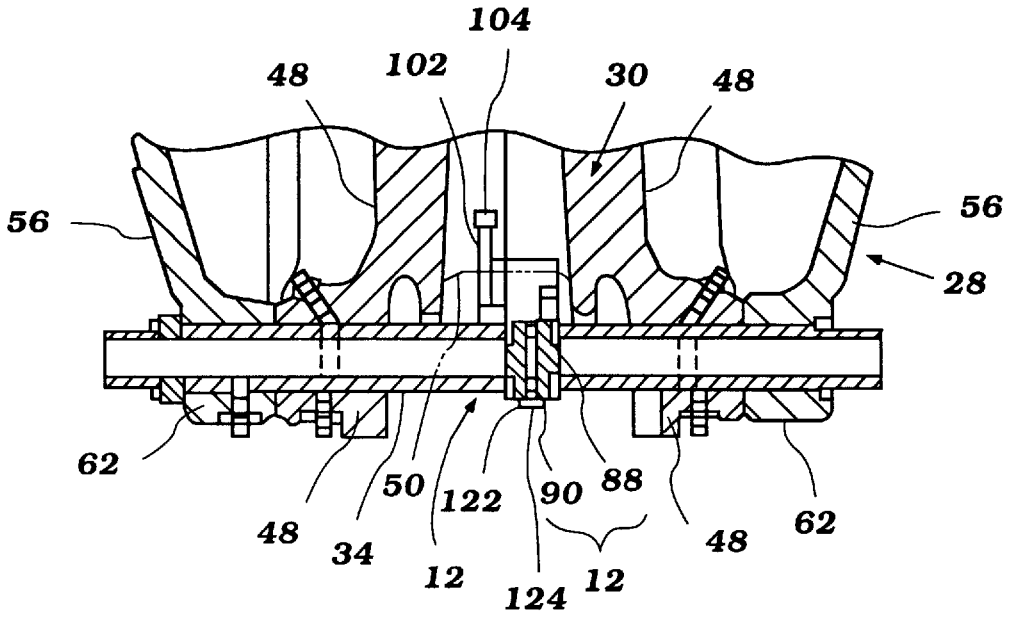
FIG. 4 is a partial, cross-sectional top plan view of the tilt and trim device of FIG. 2 taken along line 4—4.

With reference to FIGS. 2–4, the coupling bracket 90 of the trim sensor 12 has a shape similar to that of the C-shaped bracket 92 of the sensor body 88. In the illustrated embodiment, the coupling bracket 90 has an arcuate groove defined between abutment ends. Each abutment end includes a through-hole which is position to cooperate with the threaded holes on the sensor body 88. The abutment ends of the coupling bracket 90 desirably are coextensive with the abutment ends 96 of the sensor body 88.

The groove of the coupling bracket 90 has an arcuate shape. The radius of the groove desirably matches the radius of the pivot pin 34. The origin of the radius, however, lies slightly in behind the abutment ends of the coupling bracket 90 to promote contact between the surface of the groove and the pivot pin 34 when the trim sensor 12 is attached.

A pair of screws 122 attach the sensor body 88 and the coupling bracket 90 together and about the pivot pin 34. Each screw 122 passes through one of the through-hole in the coupling bracket 90 and engages the corresponding threaded hole on the sensor body 88. The screws 122 draw the coupling bracket 90 and the sensor body 88 together and against the pivot pin 34 to secure the trim sensor 12 on the pivot pin 34. In this manner, the sensor body 88 of the trim sensor 12 is fixed to the pivot pin 34 and remains stationary during adjustments of the trim angle.

As appreciated from FIGS. 2 and 3, the heads 124 of the screws 122 are easily accessible from within the watercraft 18. No portion of the clamping bracket 28 or the swivel bracket 30 covers the screws heads 124 or the coupling bracket 90.

With reference to FIG. 3, the sensor arm 102 extends beneath the central rib 50 of the swivel bracket 30 with the sensor body 88 attached to the pivot pin 34. The spring 110 biases the contact element 104 at the end of the sensor arm 102 against the bottom contact surface 52 of the rib 50.

When the swivel bracket 30 pivots about the pivot pin 34 during trim adjustments, the contact element 104 follows the movement of the rib 50. For instance, when the tilt and trim assembly trims up the outboard motor 14, the contact surface 52 of the rib 50 rises. The spring 110 causes the sensor arm 102 to follow this movement, which in turn, causes the sensor shaft 100 to rotate (clockwise in the illustrated embodiment). The sensor 98 in turn detects the rotation of the sensor shaft 100 and generates a signal indicative of the degree to which the sensor shaft 100, and thus the swivel bracket 30, have rotated. A conventional electronic control unit receives this information from the sensor 12 through an electrical cable 126 (see FIG. 2) and determines the trim position of the outboard motor 14. The electronic control unit operates the hydraulic circuit with the aid of this information.

The above-described coupling of the trim sensor 12 allows a technician to easily adjust the trim sensor to a zero degree with the outboard motor 14 in a fully lowered position (i.e., in a full trim down position). The technician can loosen the screws 122 on the sensor 12 and rotate the sensor body 88 about the pivot pin 34 until a zero reading from the sensor 98 is obtained with the outboard motor 14 in the desired position. The technician then tightens the screws 122 to maintain this position of the sensor 12 on the pivot pin. No portion of the clamping bracket 28 or the swivel bracket 30 need to be removed or the outboard motor raised to accomplish this procedure.

Replacement of the trim sensor also is made easy by the convenient position of the trim sensor. With no structure of the swivel and clamping brackets 28, 30 covering the sensor 12, the technician can readily remove and replace with trim sensor 12. The outboard motor 14 does not have to be raised to accomplish this repair.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A tilt and trim apparatus for moving an outboard drive of a watercraft between a raised position and a lowered position, the tilt and trim apparatus comprising a first member attachable to a watercraft and a second member attachable to the outboard drive, the first and second members being interconnected with the second member being rotatable relative to the first member, said second member also supporting the outboard drive such that the outboard drive is rotatable with the second member relative to the first member, and a sensor operating between the first and second members to determine the angular position of the second member and the outboard drive relative to the first member, the sensor being arranged between the first and second members with an exterior portion and positioned to be exposed on the front side of the apparatus with the outboard drive in the lowered position, the sensor including a follower arm and a spring arranged to bias the follower arm to maintain contact with one of the first and second members.

2. A tilt and trim apparatus as in claim 1, wherein said sensor comprises a sensor body and a coupling bracket which attach to one of said first and second members, the sensor body including the sensor arm which contacts the other of said first and second members.

3. A tilt and trim apparatus as in claim 1, wherein the first member comprises a pivot pin supported by a clamping bracket and the second member comprises a swivel bracket which includes a pair of lugs through which the pivot pin passes.

4. A tilt and trim apparatus as in claim 3, wherein said sensor is mounted to said pivot pin.

5. A tilt and trim apparatus as in claim 4, wherein said sensor includes a sensor body and a coupling bracket which together fit around the pivot pin.

6. A tilt and trim apparatus as in claim 5, wherein fasteners secure the sensor body and the coupling bracket to the pivot pin, the fasteners being located at a position on the sensor which is accessible from a front side of the clamping bracket.

7. A tilt and trim apparatus as in claim 5, wherein said sensor body includes the follower arm which contacts a surface of the swivel bracket, and said spring biases the follower arm against the swivel bracket surface.

8. A tilt and trim apparatus as in claim 7, wherein the swivel bracket surface is formed on a rib which is positioned between the lugs of the swivel bracket.

9. A tilt and trim apparatus as in claim 7, wherein the swivel bracket surface which the sensor follower arm contacts, lies generally parallel to an axis through the pivot pin.

10. A tilt and trim apparatus as in claim 1 additionally including means for mounting the sensor to one of the first and second members.

11. A watercraft having a tilt and trim apparatus for moving an outboard drive of the watercraft between a raised position and a lowered position, the watercraft comprising a tilt and trim system having a first member attached to the watercraft and a second member attached to the outboard drive, the first and second members being interconnected with the second member being rotatable relative to the first member, the second member also supporting the outboard drive such that the outboard drive is rotatable with the second member relative to the first member, and a sensor operating between the first and second members to determine the angular position of the second member and the outboard drive relative to the first member, the sensor being arranged between the first and second members on an exterior surface and positioned to be exposed on the front side of the apparatus with the outboard drive in the lowered position whereby the sensor is accessible from the watercraft, the sensor including a follower arm and a spring arranged to bias the follower arm to maintain contact with one of the first and second members.

12. A watercraft as in claim 11, wherein said sensor comprises a sensor body and a coupling bracket which attach to one of said first and second members, the sensor body including the sensor arm which contacts the other of said first and second members.

13. A watercraft as in claim 11, wherein the first member comprises a pivot pin supported by a clamping bracket and the second member comprises a swivel bracket which includes a pair of lugs through which the pivot pin passes.

14. A watercraft as in claim 13, wherein said sensor is mounted to said pivot pin.

15. A watercraft as in claim 14, wherein said sensor includes a sensor body and a coupling bracket which together fit around the pivot pin.

16. A watercraft as in claim 15, wherein fasteners secure the sensor body and the coupling bracket to the pivot pin, the fasteners being located at a position on the sensor which is accessible from a front side of the clamping bracket.

17. A watercraft as in claim 15, wherein said sensor body includes the follower arm which contacts a surface of the swivel bracket, and said spring biases the follower arm against the swivel bracket surface.

18. A watercraft as in claim 17, wherein the swivel bracket surface is formed on a rib which is positioned between the lugs of the swivel bracket.

19. A watercraft as in claim 17, wherein the swivel bracket surface which the sensor follower arm contacts, lies generally parallel to an axis through the pivot pin.

20. A watercraft as in claim 11 additionally including means for mounting the sensor to one of the first and second members.

* * * * *